US007162196B2

(12) United States Patent
Zampell

(10) Patent No.: US 7,162,196 B2
(45) Date of Patent: Jan. 9, 2007

(54) IMAGING DEVICES INCLUDING DOCUMENT FINISHING CAPABILITY

(75) Inventor: Richard V. Zampell, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/725,652

(22) Filed: Dec. 2, 2003

(65) Prior Publication Data

US 2005/0117946 A1 Jun. 2, 2005

(51) Int. Cl.
*G03G 15/00* (2006.01)
*B41J 29/02* (2006.01)

(52) U.S. Cl. ..... 399/407; 399/410; 400/693

(58) Field of Classification Search ..... 399/393, 399/405, 407, 408, 410; 400/691, 692, 693
See application file for complete search history.

(56) References Cited

U.S. PATENT DOCUMENTS

| | | | | |
|---|---|---|---|---|
| 5,053,831 | A | 10/1991 | Ishiguro et al. | |
| 5,481,354 | A * | 1/1996 | Nakajima | 399/371 |
| 5,860,644 | A * | 1/1999 | Takeuchi et al. | 271/4.01 |
| 6,210,051 | B1 * | 4/2001 | Sakurai | 400/62 |
| 6,436,024 | B1 | 8/2002 | Kobayashi | |
| 6,460,843 | B1 * | 10/2002 | Dim et al. | 270/58.07 |
| 6,549,749 | B1 * | 4/2003 | Guerrero | 399/407 |
| 6,801,750 | B1 * | 10/2004 | Kawahira | 399/407 |
| 2003/0102618 | A1 | 6/2003 | Sesek | |

* cited by examiner

*Primary Examiner*—Ren Yan

(57) ABSTRACT

In one embodiment, an imaging device includes a main unit that includes a print mechanism, and an auxiliary unit that includes a document finishing mechanism.

24 Claims, 3 Drawing Sheets

IMAGING DEVICES INCLUDING DOCUMENT FINISHING CAPABILITY

BACKGROUND

Less expensive imaging devices typically do not include the document finishing capabilities of many high-end imaging devices such as stapling, binding, hole punching, folding, and trimming. However, many users of less expensive imaging devices desire such finishing capabilities so that they can not only print hardcopy pages, but further organize or convert those pages into finished documents. In small office and home environments in which space may be at a premium, it is undesirable to have to accommodate additional equipment.

BRIEF DESCRIPTION OF THE DRAWINGS

The disclosed imaging devices can be understood with reference to the following drawings. The components in the drawings are not necessarily to scale.

DETAILED DESCRIPTION

Many users desire document finishing capability, but may not wish to purchase free-standing document finishing equipment. As described in the following, however, such document finishing capability can be integrated into a relatively small, inexpensive imaging device in such a manner so that the footprint of the imaging device is not increased. Therefore, the imaging device user can finish documents, for instance in a small office or home setting, without having to provide additional space for free-standing document finishing equipment.

Figure 1:
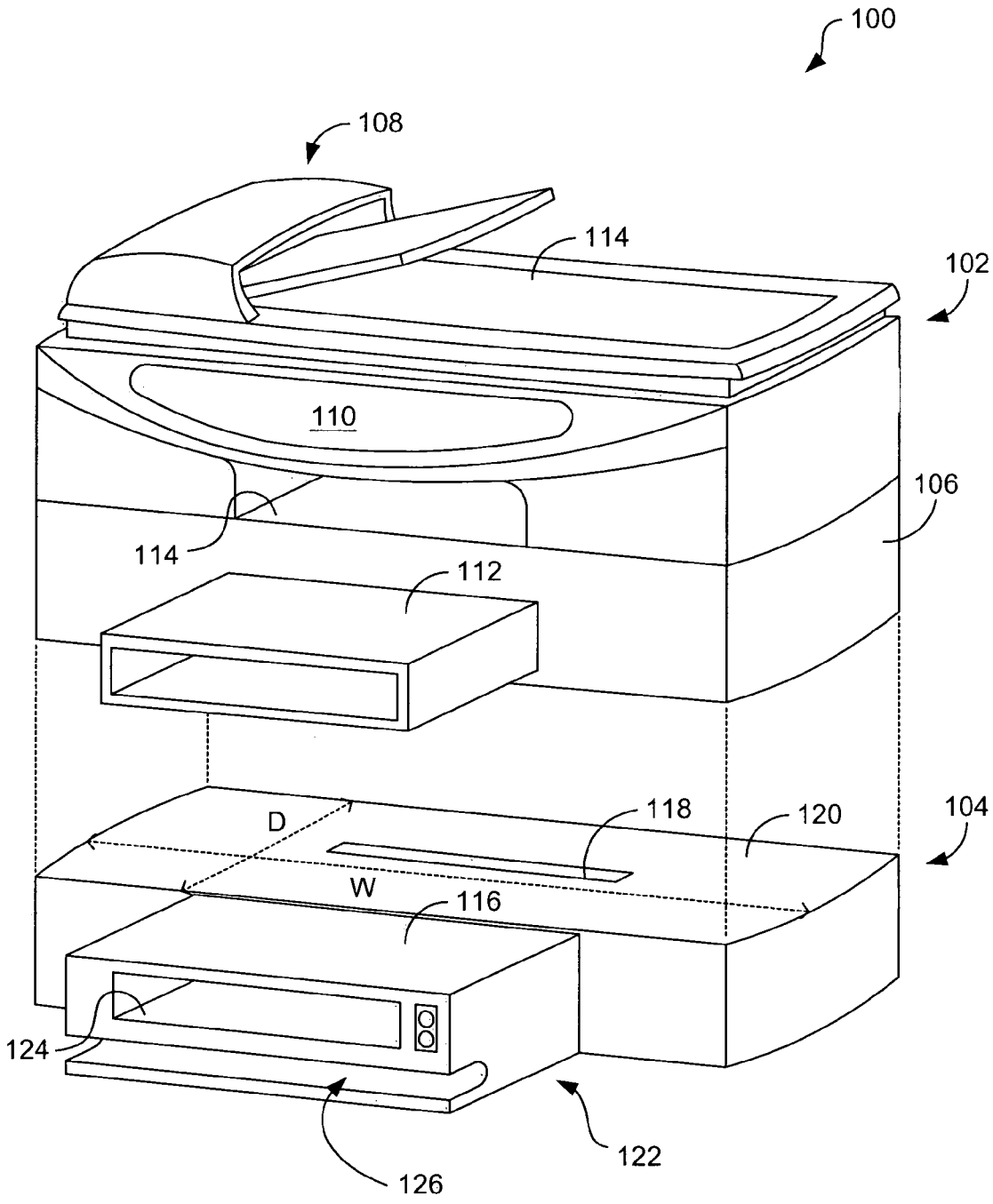
FIG. 1 is a partially exploded perspective view of an embodiment of an imaging device that comprises document finishing capability.

Referring to the drawings, in which like numerals indicate corresponding parts throughout the several views, FIG. 1 illustrates an example imaging device 100 that includes finishing capability. More particularly, the imaging device 100 comprises at least one integral finishing mechanism that does not increase the footprint of the imaging device. As shown in FIG. 1, the imaging device 100 includes a main unit 102 and a modular auxiliary unit 104 that operates in conjunction with the main unit.

The main unit 102 comprises an outer housing 106 that at least encloses a print mechanism. In the example of FIG. 1, the imaging device 100 includes an automatic document feeder (ADF) 108 that draws media into the imaging device for the purpose of scanning and/or photocopying. Therefore, the outer housing 106 further encloses a scanning mechanism. Due to the printing, scanning, and copying capabilities of the imaging device 100, the imaging device may be designed as an all-in-one device or a multifunction (MFP) device. In alternative embodiments, however, the imaging device 100 may only comprise printing capability, copy capability, or a combination of printing capability and one or more other capabilities, such as faxing and/or digital sending.

The main unit 102 further comprises a control panel 110 that may be used to control operation of the imaging device 100 and adjust device settings. In addition, the main unit 102 comprises a media input tray 112 that is configured to hold media, such as paper, for input into the device to facilitate printing and/or photocopying. The main unit 102 may include one or more output areas 114 at which printed media are output from the imaging device 100.

The auxiliary unit 104 is adapted for coupling with the main unit 102. In particular, as is depicted by dashed lines in FIG. 1, the auxiliary unit 104 is configured to receive and support the main unit 102 in a stacked configuration in which the main unit rests atop the auxiliary unit 104 (see also FIGS. 3A and 3B). In the example of FIG. 1, the auxiliary unit 104 comprises a further media input tray 116 that, like input tray 112, is configured to hold media for input into the imaging device 100. Such media can be fed to the main unit 102 through an opening 118 provided in an outer housing 120 of the auxiliary unit 104.

In addition to the media input tray 116, the auxiliary unit 104 comprises at least one integral document finishing mechanism. In the example of FIG. 1, one such finishing mechanism 122 is integrated into the media input tray 116 such that the mechanism is located below a support surface 124 on which media are supported in the tray. Access to the finishing mechanism 122 can be obtained through a slot 126 formed in the media input tray 116. As is described below, the document finishing mechanism(s) can be located in other locations within the auxiliary unit 104. For instance, one or more finishing mechanisms can be provided to the side of the media input tray 116 (see, e.g., FIG. 3B). Regardless, the finishing mechanism or mechanisms is/are integrated into the auxiliary unit 104 such that finishing is provided by the imaging device 100, as opposed to a separate device, when the main unit 102 is coupled with the auxiliary unit 104.

As is apparent from FIG. 1, the auxiliary unit 104 has width, W, and depth, D, dimensions that are similar or identical to the bottom of the main unit 102 such that the auxiliary unit has substantially the same footprint and same design themes as the main unit. With such a configuration, addition of the auxiliary unit 104, and the document finishing capability it provides, to the main unit 102 does not increase the desktop space requirements of the imaging device 100.

The nature of the document finishing mechanism 122 depends upon the particular implementation. By way of example, the document finishing mechanism 122 is capable of one or more of stapling, binding, hole punching, folding, and trimming. Optionally, more than one type of document finishing mechanism can be integrated into the auxiliary unit 104. For example, a stapling mechanism can be provided in one location within the auxiliary unit 104, and a binding mechanism can be provided in another location within the auxiliary unit 104. In some embodiments, various different modular auxiliary units 102 may be available for purchase, each having different finishing capabilities. For instance, one auxiliary unit 104 can provide stapling functionality, another auxiliary unit 104 can provide binding functionality, and so forth. Depending upon the implementation, such auxiliary units 102 may be installable by the customer, thereby obviating the need for a service call.

Figure 2:
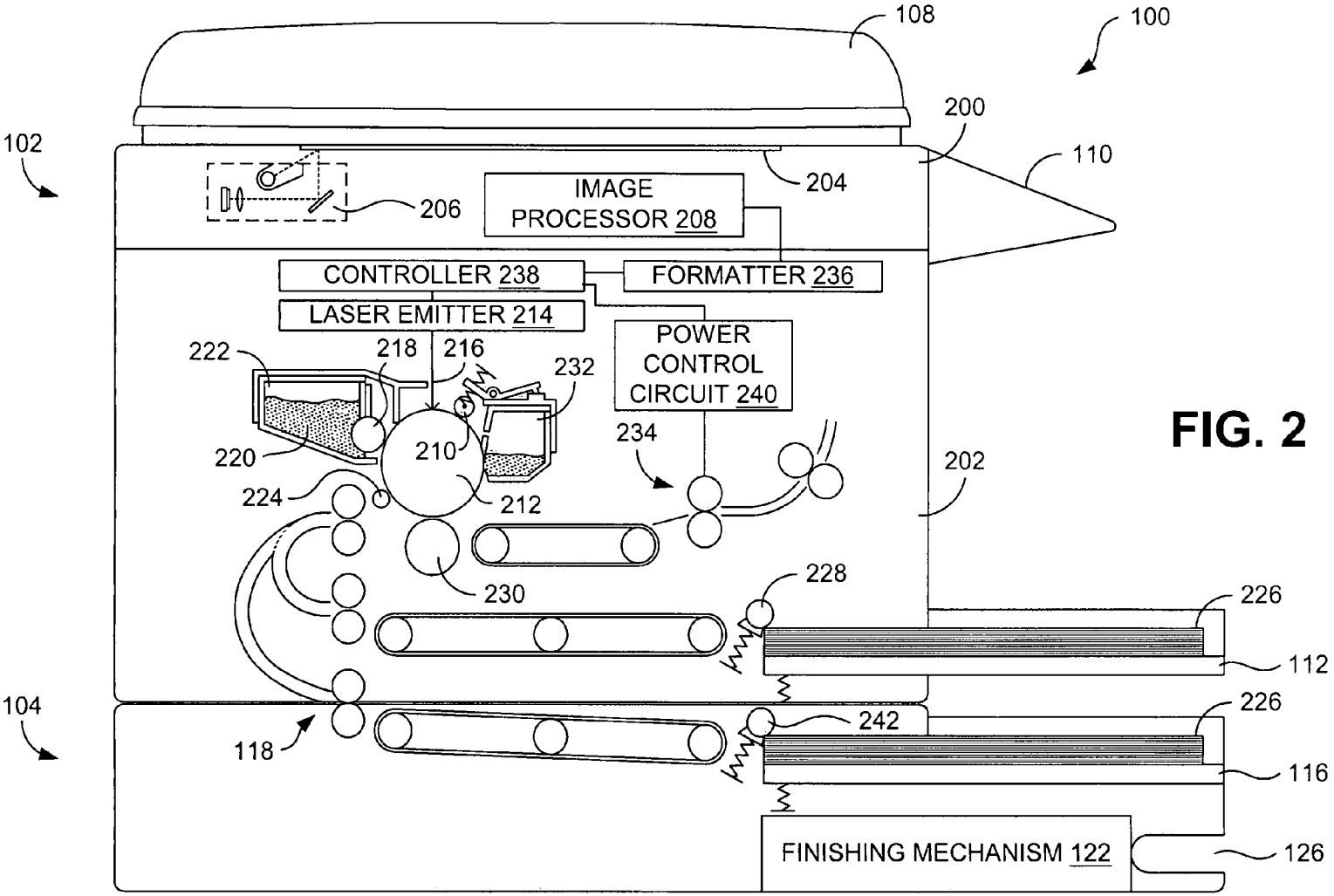
FIG. 2 is a schematic side view of an embodiment of architecture for the imaging device shown in FIG. 1.

FIG. 2 is a schematic view of an example architecture for the imaging device 100 of FIG. 1. The main unit 102 comprises a scanning unit 200, which is responsible for scanning media, and a printing unit 202, which is responsible for generating hard copy documents. The scanning unit 200 comprises a platen 204 on which media to be scanned may be positioned, a scanning module 206 that is used to capture image data from the media, and an image processor 208 that processes the captured image data, for instance for the purpose of printing by the printing unit 202. The scanning module 206 may comprise, for example, a light source, a reflector, and an image sensor, such as a linear photosensor array (e.g., linear charge-coupled device (CCD)). The scanning module 206 may be configured to travel along the length of the platen 204 (or a portion thereof where appropriate) to scan media placed on the platen.

The printing unit 202 comprises the print mechanism that is used to generate hard copy documents, either from data provided by a host device (e.g., personal computer (PC)) or by the scanning unit 200. In the example of FIG. 2, the print mechanism is a laser print mechanism. It is noted, however, that the print mechanism could, alternatively, comprises an ink print mechanism or other suitable print mechanism. The print mechanism shown in FIG. 2 includes a charging apparatus 210, such as a charge roller, that is used to charge the surface of a photoconductor member 212, such as a photoconductor drum, to a predetermined voltage. By way of example, the photoconductor member 212 comprises an organic photoconductor (OPC).

A laser diode is provided within a laser emitter 214 that emits a laser beam 216 that is pulsed on and off as it is swept across the surface of the photoconductor member 212 to selectively discharge the surface of the photoconductor member. In the orientation shown in FIG. 2, the photoconductor member 212 rotates in the counterclockwise direction. A developing member 218, such as a developing roller, is used to develop a latent electrostatic image residing on the surface of photoconductor member 212 after the surface voltage of the photoconductor member has been selectively discharged. The developing member 218 develops the image using toner 220 that is, for example, stored in a toner reservoir 222 of a removable print cartridge. The developing member 218 can, for instance, include an internal magnet (not shown) that magnetically attracts the toner 220 from the toner reservoir 222 to the surface of the developing member. As the developing member 218 rotates (clockwise in FIG. 2), the toner 220 is attracted to the surface of the developing member and is then transferred across a gap between the surface of the photoconductor member 212 and the surface of the developing member to develop the latent electrostatic image. Optionally, the print mechanism can include an erasing apparatus, such as an erase lamp 224, that is used to erase at least a portion of the latent electrostatic charge on the surface of the photoconductor member 212 after transfer of the toner to a recording medium.

Recording media 226, for instance sheets of paper, are loaded from the input tray 112 by a pickup roller 228 into a conveyance path of the imaging device 100. Each recording medium 226 is individually drawn through the device 100 along the conveyance path by various drive rollers and/or conveyors (unnumbered) such that the leading edge of each recording medium is synchronized with the rotation of the region on the surface of the photoconductor member 212 that comprises the developed toner image. As the photoconductor member 212 rotates, the toner adhered to the member contacts the recording medium 226, which has been charged by a transfer member 230, for example a transfer roller, such that the toner particles are moved away from the surface of the photoconductor member and onto the surface of the recording medium.

The transfer of toner particles from the surface of the photoconductor member 212 to the surface of the recording medium 226 normally is not completely efficient. Therefore, if toner particles remain on the surface of the photoconductor member 212, those toner particles are removed from the photoconductor member and deposited in a toner waste hopper 232. As the recording medium 226 moves along the conveyance path past the photoconductor member 212, the recording medium is delivered to a fusing system 234 that, for example, comprises a fuser roller and a pressure roller that form a nip that applies heat and pressure to the recording medium 226 to fuse the toner to the surface of the recording medium. After fusing is completed, the recording medium 226 is output from the imaging device 100, for instance in one of the output areas 114 (FIG. 1).

As identified in FIG. 2, the printing unit 202 further includes a formatter 236 and an imaging device controller 238. The formatter 236 receives data transmitted from a host device or received from the image processor 208 and converts the data into a stream of print data that is sent to the controller 238. The formatter 236 and the controller 238 exchange data necessary for controlling the printing process, and the controller supplies the stream of print data to the laser emitter 214. The print data stream sent to the laser emitter 214 causes the laser diode of the emitter to pulse on and off to create the latent electrostatic image on the photoconductor member 212.

In addition to providing the print data stream to the laser emitter 214, the controller 238 controls a high voltage power supply (not shown) that supplies voltages and currents to the components used in the imaging device 100, in some embodiments including the finishing mechanism(s) of the auxiliary unit 104. The controller 238 further controls a drive motor (not shown) that drives the printer gear train (not shown) as well as the various clutches and feed rollers (not shown) necessary to move recording media 226 through the conveyance path of the device 100. A power control circuit 240 controls the application of power to the fusing system 234.

The media input tray 116 of the auxiliary unit 104 also holds media 226 which are fed up to the main unit 102 with a pickup roller 242 and various drive rollers and/or conveyors through the opening 118. As is further indicated in FIG. 2, the auxiliary unit 104 further houses a document finishing mechanism 122. As noted above in relation to FIG. 1, the finishing mechanism 122 can be accessed and used via the slot 126 in which a document, for example a document printed by the imaging device 100, can be inserted (see FIG. 3A). The finishing mechanism 122 provided in the auxiliary unit 104 can be powered by the main unit power supply or by an independent power supply (not shown) contained within the auxiliary unit 104.

Figure 3A:
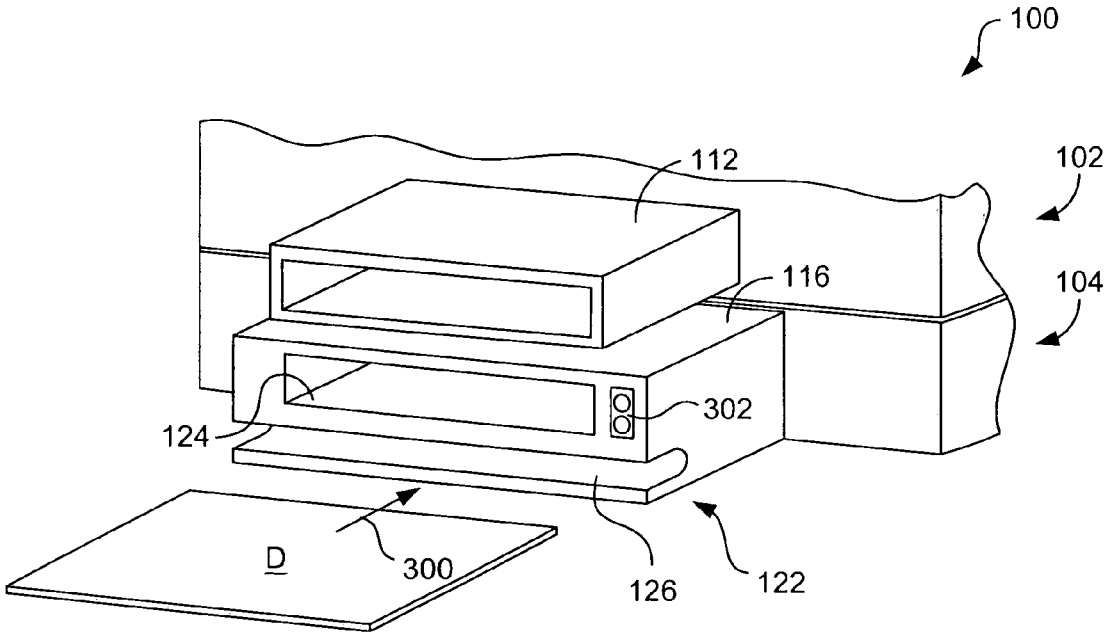
FIG. 3A is a schematic view that depicts a first example of finishing a document using an integral document finishing mechanism.

FIG. 3A illustrates a first example of finishing a document D using the imaging device 100. In particular, illustrated is binding of the document D using a document finishing mechanism 122 integrated with the media input tray 116 of the auxiliary unit. In the example of FIG. 3A, the document D is to be bound along a length of the document. Therefore, the document D is oriented such that the length, or long axis, of the document is parallel to a longitudinal axis of the slot 126. As shown in FIG. 3A, the document D is moved, along direction 300, toward the slot 126 that provides access to the finishing mechanism 122. Once the document D is inserted into the slot 126, the edge of the document inside the slot is bound by the finishing mechanism 122. By way of example, the document D is bound with a spiral binding. The binding process can be automatically activated by the detected presence of the document D, or can be manually activated using various controls 302 provided on the auxiliary unit 104 or the control panel 110 (FIG. 1). Once the document D has been bound by the finishing mechanism 122, the document can be withdrawn from the slot 126.

Figure 3B:
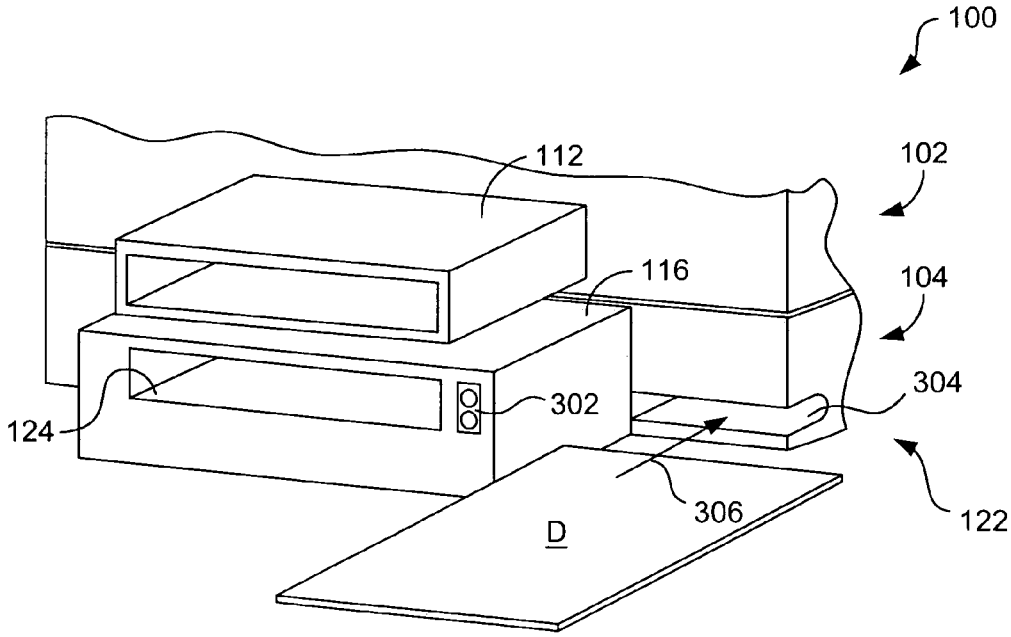
FIG. 3B is a schematic view that depicts a second example of finishing a document using an integral document finishing mechanism.

FIG. 3B illustrates a second example of finishing a document D using the imaging device 100. In particular, illustrated is stapling a document D using an alternative document finishing mechanism 122 of the auxiliary unit 104. In the example of FIG. 3B, the document D is to be stapled adjacent a top end of the document. Therefore, the document D is oriented such that the length, or long axis, of the document is perpendicular to a longitudinal axis of an alternative slot 304 formed in the auxiliary unit 104 to the side of the media input tray 116. As shown in FIG. 3B, the document D is moved, along direction 306, toward the slot 304 and inserted therein so that the edge of the document inside the slot is stapled by the finishing mechanism 122. The stapling process can be automatically activated by the detected presence of the document D, or can be manually activated using the controls 302 or the control panel 110 (FIG. 1). Once the document D has been stapled by the finishing mechanism 122, the document can be withdrawn from the slot 304.

In view of the above, it can be appreciated that the imaging device 100 provides the added functionality of document finishing without expanding the footprint of the imaging device. Therefore, user need not purchase, and provide space for, separate finishing equipment to obtain such document finishing.

What is claimed is:

1. An imaging device, comprising:

a main unit that includes a print mechanism and a media input tray; and a physically separate auxiliary unit that is positioned below the main unit, couples with the same in stacked configuration, and physically supports the main unit, the auxiliary unit including an integral document finishing mechanism and a further media input tray, wherein the document finishing mechanism is accessible from an environment outside the imaging device through a slot provided in an exterior of the auxiliary unit such that printed media is fed through the slot into the document finishing mechanism from outside the auxiliary unit, wherein the auxiliary unit has a footprint that is substantially the same as a footprint of the main unit.

2. The device of claim 1, wherein the print mechanism comprises a laser print mechanism.

3. The device of claim 1, wherein the print mechanism comprises an ink print mechanism.

4. The device of claim 1, wherein the main unit further includes a scanning unit.

5. The device of claim 1, wherein the document finishing mechanism is integrated with the media input tray.

6. The device of claim 1, wherein the document finishing mechanism is located to a side of the media input tray.

7. The device of claim 1, wherein the document finishing mechanism comprises a stapling mechanism.

8. The device of claim 1, wherein the document finishing mechanism comprises a spiral binding mechanism.

9. The device of claim 1, wherein the document finishing mechanism comprises a hole punching mechanism.

10. The device of claim 1, wherein the document finishing mechanism comprises a folding mechanism.

11. The device of claim 1, wherein the document finishing mechanism comprises a trimming mechanism.

12. The imaging device of claim 1 wherein the auxiliary unit is positioned below the media input tray.

13. The device of claim 1, wherein a portion of the printed media remains accessible from outside the auxiliary unit as the printed media is inserted into the slot for finishing.

14. An auxiliary unit for an imaging device, wherein the auxiliary unit is located physically separate from a main unit of the imaging device and is couplable in a stacked configuration with the main unit including a print mechanism and a media input tray, so that the auxiliary unit is positioned below the main unit, wherein the auxiliary unit to comprises:

an integral document finishing mechanism accessible from an environment outside the imaging device through a slot provided in the exterior of the auxiliary unit such that printed media is fed through the slot into the document finishing mechanism from outside the auxiliary unit; and a further media input tray; wherein the auxiliary unit has a footprint that is substantially the same as the footprint of the main unit.

15. The auxiliary unit of claim 14, wherein the document finishing mechanism is integrated with the further media input tray.

16. The auxiliary unit of claim 14, wherein the document finishing mechanism is located to a side of the media input tray.

17. The auxiliary unit of claim 14, wherein the document finishing mechanism comprises a stapling mechanism.

18. The auxiliary unit of claim 14, wherein the document finishing mechanism comprises a binding mechanism.

19. The auxiliary unit of claim 14, wherein the document finishing mechanism comprises a hole punching mechanism.

20. The auxiliary unit of claim 14, wherein the document finishing mechanism comprises a folding mechanism.

21. The auxiliary unit of claim 14, wherein the document finishing mechanism comprises a trimming mechanism.

22. The auxiliary unit of claim 14, which is couplable with the main unit in the stacked configuration so that it is positionable below the media input tray.

23. The auxiliary unit of claim 14, wherein media are feedable to the main unit from the further media input tray.

24. The auxiliary unit of claim 14, wherein a portion of the printed media remains accessible from outside the auxiliary unit as the printed media is inserted into the slot for finishing.

* * * * *

UNITED STATES PATENT AND TRADEMARK OFFICE

CERTIFICATE OF CORRECTION

PATENT NO. : 7,162,196 B2
APPLICATION NO. : 10/725652
DATED : January 9, 2007
INVENTOR(S) : Richard V. Zampell It is certified that error appears in the above-identified patent and that said Letters Patent is hereby corrected as shown below:

In column 6, line 17, in Claim 14, delete “located” and insert -- locatable --, therefor.

In column 6, line 21, in Claim 14, after “auxiliary unit” delete “to”.

Signed and Sealed this

Second Day of December, 2008

JON W. DUDAS
*Director of the United States Patent and Trademark Office*